US006551459B1

(12) United States Patent
Lumiala et al.

(10) Patent No.: US 6,551,459 B1
(45) Date of Patent: Apr. 22, 2003

(54) REGULATION SYSTEM FOR THE SHORT CIRCULATION AND HEADBOX OF A PAPER MACHINE OR EQUIVALENT

(75) Inventors: Juhana Lumiala, Jyväskylä (FI); Hannu Lepomäki, Laukaa (FI); Petri Jetsu, Vaajakoski (FI); Petri Nyberg, Jyväskylä (FI); Hannu Karema, Jyväskylä (FI); Markku Kellomäki, Haapaniemi (FI); Juha Salmela, Jyskä (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/088,714

(22) PCT Filed: Sep. 20, 2000

(86) PCT No.: PCT/FI00/00797

§ 371 (c)(1),
(2), (4) Date: Jun. 10, 2002

(87) PCT Pub. No.: WO01/21885

PCT Pub. Date: Mar. 29, 2001

(30) Foreign Application Priority Data

Sep. 21, 1999 (FI) ..... 19992016

(51) Int. Cl.[7] ..... D21F 1/02; D21F 1/66; D21G 9/00

(52) U.S. Cl. ..... 162/198; 162/263; 162/258; 162/259; 162/DIG. 11

(58) Field of Search ..... 162/198, 199, 162/263, 258, 259, 189–190, DIG. 11; 700/127–129

(56) References Cited

U.S. PATENT DOCUMENTS

| | | | | |
|---|---|---|---|---|
| 3,573,160 A | | 3/1971 | Lopas | |
| 4,133,713 A | | 1/1979 | Chuang | |
| 4,504,358 A | * | 3/1985 | Hakansson | 162/264 |
| 5,812,404 A | * | 9/1998 | Hamalainen et al. | 364/471.02 |
| 5,944,957 A | * | 8/1999 | Fagerlund et al. | 162/258 |
| 6,086,716 A | * | 7/2000 | Watson et al. | 162/198 |
| 6,267,845 B1 | | 7/2001 | Hautala et al. | |
| 6,319,362 B1 | * | 11/2001 | Huhtelin et al. | 162/198 |
| 6,322,666 B1 | * | 11/2002 | Luontama et al. | 162/198 |
| 2002/0060017 A1 | * | 5/2002 | Kuusisto et al. | 162/198 |

FOREIGN PATENT DOCUMENTS

| | | |
|---|---|---|
| FI | 103676 | 8/1999 |
| FI | 992015 | 9/1999 |
| GB | 2 201 173 A | 8/1988 |
| WO | WO 01/21885 | 3/2001 |

OTHER PUBLICATIONS

Richard J. Kerekes & Carolyn J. Schell, "Effects of Fiber Length and Coarseness on Pulp Flocculation", Tappi Journal, Feb. 1995, pp. 133–139, see pp. 134–135, vol. 78, No. 2.

* cited by examiner

*Primary Examiner*—Jose A. Fortuna
(74) *Attorney, Agent, or Firm*—Lathrop & Clark LLP

(57) ABSTRACT

A headbox (10) has a stock inlet header, a tube bank, a tubulence generator and a slice channel. Measurement targets ($P_A$, $P_B$, $P_C$, P, $P_E$) are provided with means for making measurements of the fiber mobility of the fiber suspension, then controlling the flow state of the suspension. Sensors on the width of the headbox (10) or traversing sensors are positioned on different width points of the headbox (10) and arranged to measure the fiber mobility profile, with means for changing the flow state on the basis of the measurements. Apparatus for diluting the thick stock into headbox consistency and units for cleaning the stock to be fed into the headbox may be provided. Sensors may be disposed in the short circulation pipes or cleaning units arranged to measure the fiber mobility of the fiber suspension with means for changing the flow state on the basis of the measurement data.

27 Claims, 5 Drawing Sheets

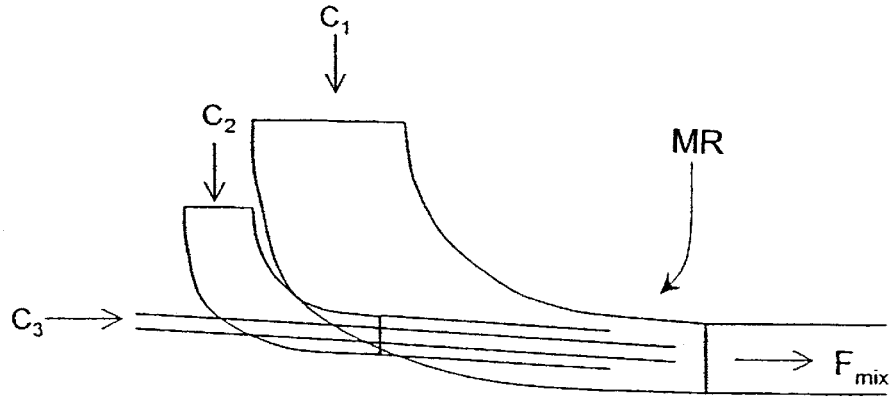
FIG. 4A
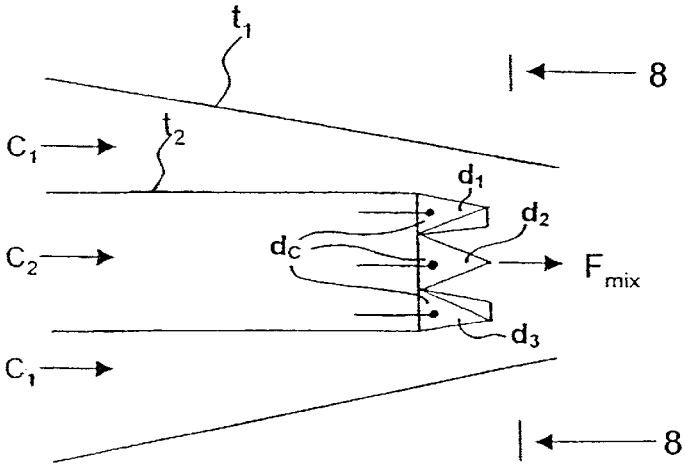
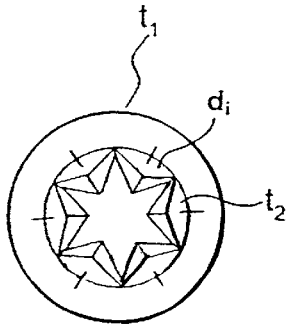
FIG.8
FIG. 4B
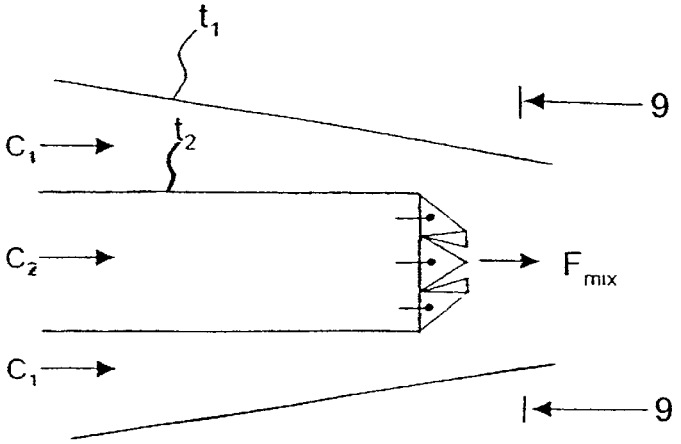
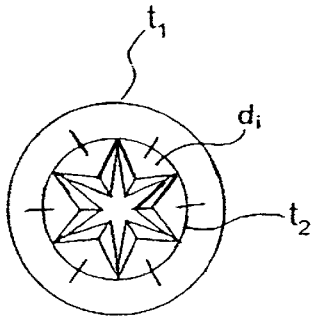
FIG.9
FIG. 4C

REGULATION SYSTEM FOR THE SHORT CIRCULATION AND HEADBOX OF A PAPER MACHINE OR EQUIVALENT

BACKGROUND OF THE INVENTION

The present invention relates to a method in the measurement and control of the short circulation and the headbox of a paper machine or equivalent. The present invention relates also to a headbox and the short circulation.

The invention relates to the arrangement of the short circulation and the headbox of a paper machine or equivalent. The paper machine or equivalent refers in the present context to a machine with which paper-like product such as paper, board or tissue paper is produced.

The stock feeding of the paper machine is in general as follows. The stock components are stored in the paper mill in separate storage tanks, wherefrom they are fed into proportioning tanks and therefrom further into a common mixing tank, in which the stock components are intermixed. From the mixing tank the stock is fed into a machine tank, wherefrom the stock, being in general in about 3% consistency, is fed into a short-circulation wire pit. In the wire pit the thick stock is diluted into a headbox consistency, which is in general about 1%.

The fibres and fillers to be used as raw material are taken to the wire through a headbox and conveyed by water. The filtrate having passed through the wire, containing fibrous agents and fillers in great quantities, is returned as a filtrate of the thick stock from the machine tank back to the wire through the headbox. A flow link thus formed is called a short circulation.

Impurities may enter in the short circulation together with the thick stock or through other ways which have to be removed before the headbox. This is carried out with short-circulation cleaning apparatus, such as hydrocyclones, screens, machine screens and deaeration tanks.

The short circulation together with the headbox in connection therewith is in general considered as the most sensitive part of the papermaking process. Any small changes in the consistency, flow or other parameters immediately affect the quality of the paper being manufactured or cause web breaks on the paper machine. The function of the short circulation in the papermaking is, among other things, to produce a fibre suspension of uniform quality, in which the various components (fibre fractions, chemicals and fillers) are intermixed into a homogeneous fluid. The good homogeneity of the stock thus produced will guarantee a uniform quality in the paper and an undisturbed production process in subsequent phases.

In the papermaking, one of the important functions of the headbox is formation of slice jet to be optimal in its flow state. In an optimal slice jet, the solid matter is distributed homogeneously, the floc size is optimal, the disturbances are minimal, and the turbulence level is under control. The essential measurable and controllable quantity is the degree of suspension fluidization, illustrating the intermobility of fibres. In the headbox, various geometrical designs are used for fluidizing the suspension, such as step changes of flow channels, adjustments of trailing elements and various surface phenomena, such as boundary layer turbulence, wherewith turbulence is generated in the flow of the suspension.

In the prior-art OptiFeed process of Metso Paper, Inc., described in patent specification FI-103676, the stock entering the paper machine is built from a number of separate (2–4) stock components, the fibrous properties of which deviate from each other and vary along with changes of the paper grade to be manufactured. The stock components are mixed into homogeneous fluid in so-called mixing reactors located in the parts of the short circulation to which several stock components are brought simultaneously.

The operation of the OptiFeed process is dependent on the goodness of the operation of the mixing reactor. In an optimal situation, the mixing should be as perfect as possible and in addition, to work for all paper grades being manufactured, even though the flow quantities of different components, depending on the quality, may vary to a great extent. The goodness of the mixing of different components being mixed as known in the art can be measured and controlled when an optimal operation is to be secured. The mixability of suspensions containing fibrous matter is dependent on the mobility of solid matter and the turbulence generated therethrough. Optimizing the generation of turbulence is implementable e.g. by means of various adjustable throttling elements, disclosed e.g. in the patent application of Metso Paper, Inc. No. FI-992015.

In the flow of fibre suspension, the fibres tend to form accumulations called flocs. If the consistency of the flow exceeds the sedimentation consistency, the flocs are built into a net-like united phase, which in the papermaking is an undesired state. The state in which the structure is completely decomposed is called fluidized. In mixing a fibrous suspension, momentary fluidization of components to be mixed is expected. The mixing is in general carried out by conducting flows of different components into one at different speeds. If the state of fluidization can be monitored, the differential speed required (shearing stress between the flows being mixed) can be set optimal. In connection with the fluidization, the structure of a fibre net or flocs is decomposed. Hereby, the state of fluidization can be estimated with the aid of floc size and its completeness with the aid of the minimum size achieved. The floc size measuring in the process circumstances is very difficult in practice.

Generating turbulence in the fibre suspension causes breaking up of fibre flocs and increased intermobility of individual fibres. Providing fluidization by increasing the turbulence requires geometric changes to add shearing stresses or a surface of a flow channel or a trailing element to produce sufficient boundary-layer turbulence. Increased fluidization as such will not cause reduction of turbulence. The fibre suspension usually tends to become re-flocculated so to speak, which can be observed as reduced fibre mobility (degree of fluidization). On the other hand, the properties of turbulence include so-called dissipation, which means changing of the kinetic energy of the turbulence into internal energy (heat) of the fluid. However, the degree of fluidization of the suspension will be decreased owing to the dissipation of turbulence. Thus, the fluidization of the suspension is a transient state, the follow-up of which is essential for the success of the papermaking process.

SUMMARY OF THE INVENTION

The objective of the present invention is to develop a method and an apparatus for real-time measuring of the short circulation of a paper machine or equivalent and of the fibre mobility of the suspension of the headbox and for controlling the flow state.

The objective of the present invention is also to provide a method and an apparatus, wherewith as optimal mixability of the fibre suspension as possible is guaranteed in different parts of the short circulation and the headbox so that the fibre suspension is in an optimal state for the subsequent phase of the process.

The method according to the invention is mainly characterized in that in the method, the selected measurement targets are provided with means for measuring the fibre mobility of the fibre suspension, and on the basis of the fibre mobility measured from the fibre suspension, the flow state of the fibre suspension is controlled.

The headbox of the invention is in turn characterized in that the headbox comprises sensors on the width of the headbox or a traversing sensor/sensors, being fitted in different width points of the headbox, and that a sensor/sensors is/are arranged to measure the fibre mobility profile of the headbox on the width of the entire headbox and that the headbox comprises means for changing the flow state on the basis of the measurement data obtained from the sensors.

The short circulation of the invention is characterized in that the short circulation comprises a sensor/sensors, disposed in the pipes of the short circulation and/or in the cleaning apparatus, and that a sensor/sensors are arranged to measure the fibre mobility of the fibre suspension in the short circulation and that the short circulation comprises means for changing the flow state on the basis of the measurement data rendered by the sensors.

According to the invention, the apparatus components used for controlling the mixture in the short circulation of a paper machine or equivalent are provided with sensors measuring the flow state, on the basis of the data obtained wherefrom the flow state is controlled by means of control devices. With a measurement and control system such as this, the furnish of the fibre suspension is controlled to be such that it is optimal for the next process phase. The solution according to the invention can be used also in cardboard and tissue machines.

In addition, with the method according to the invention, the fibre mobility of the suspension of the headbox can be measured most precisely on the entire width of the slice channel. The slice channel is provided with a row of sensors, a sensor matrix or a traversing sensor, in which the degree of fluidization of the suspension is measured in real time. In multiple-layer headboxes, a row of sensors or a sensor matrix is positioned on each layer. On the basis of the measurement data obtained from the sensors, the flow state of the suspension of the headbox is controlled, in order to make the fibre mobility, that is, the degree of fluidization, optimal. When the optimal range of variation of the fibre mobility is known for different paper grades, the quality of the paper produced can be controlled in changing running circumstances. The optimal range of variation of the fibre mobility can be determined experimentally.

BRIEF DESCRIPTION OF THE DRAWINGS

The invention is described more in detail with reference to the accompanying figures, in which

FIG. 4A presents an example of the structure of a short circulation mixing reactor.

FIG. 4B presents an actuator for controlling the mixing in a short circulation mixing reactor with the actuator in open position.

FIG. 4C presents the actuator of FIG. 3B in partly closed position.

FIG. 8 is a view taken at line 8—8 in FIG. 4B.

FIG. 9 is a view taken at 9—9 in FIG. 4C.

DESCRIPTION OF THE PREFERRED EMBODIMENTS

Figure 1:
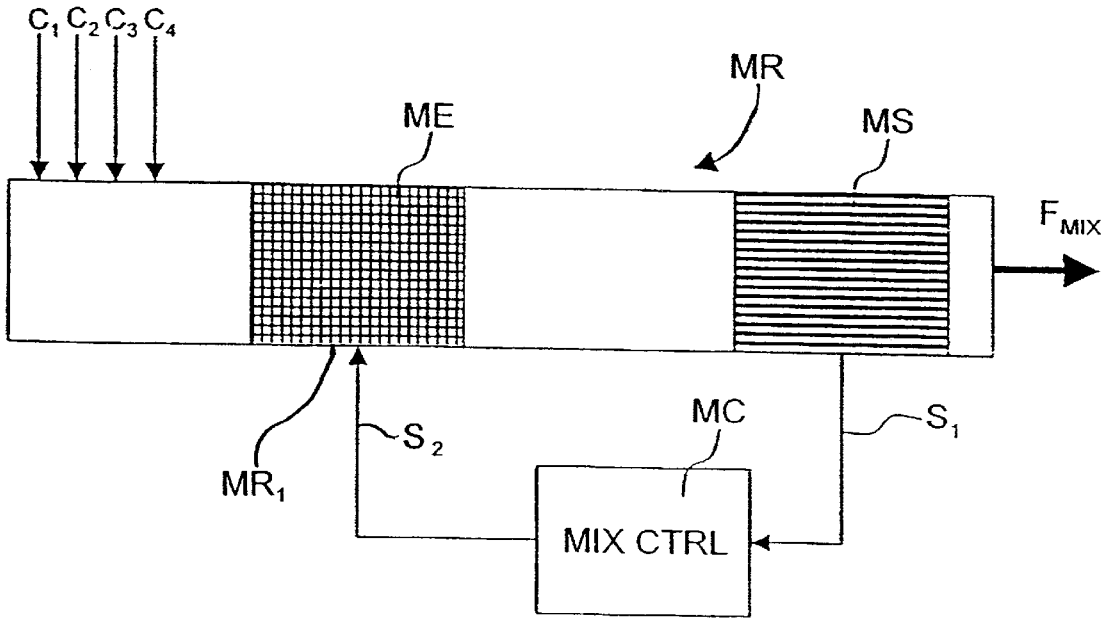
FIG. 1 is a principle block diagram representation about measurement and control of solid matter mobility in the short circulation.

FIG. 1 presents a model for optimizing the mixing of fibre suspension. On principle level, FIG. 1 presents a mixing reactor MR equivalent to the part of the short circulation to which one or more components $C_1$, $C_2$, $C_3$, $C_4$ are supplied to be mixed in the mixing reactor MR into as uniform mixture as possible. The fibre properties of the components $C_1$, $C_2$, $C_3$, $C_4$ to be mixed deviate in general from each other and their mutual ratio varies according to the paper grade to be produced. The components $C_1$, $C_2$, $C_3$, $C_4$ to be mixed are mixed in a controllable mixing element ME. According to the invention, in the volume after the mixing element ME, a mixing sensor MS is positioned to measure the homogeneity of the mixture. From the output of the mixing reactor MR, a stock flow mix is obtained, which is controlled so that its furnish is optimal as possible for the subsequent phase of the process. From the sensor MS, a measuring signal $S_1$ is obtained which is taken to the mixing control unit MC to send a control signal $S_2$ to a mixing element $MR_1$. In this manner a feedback is formed with which the control of the furnish of the invention can be carried out.

In the measurement and control system described above, the sensors to be used for measuring a flow state are e.g., rapid pressure sensors measuring pressure variations or surface friction sensors measuring acceleration. Also with different optical methods, with e.g. laser-Doppler anemometer, fibre mobility can be measured, as well as with sensors based on radioactive radiation, microwave measurement or ultrasonic sensors. On the basis of the measured fibre mobility data, turbulence is brought into a flow state, wherewith the mobility of the fibre suspension is controlled to be optimal. The volume being measured from the fibre suspension in a target being measured is tried to be selected so that it is the smallest element in which the fibres and other ingredients are mixed uniformly. The size of such volumetric element is dependent, for instance, on the medium length of fibres and its ideal size varies in different parts of the process and is dependent on the product being produced.

Figure 2:
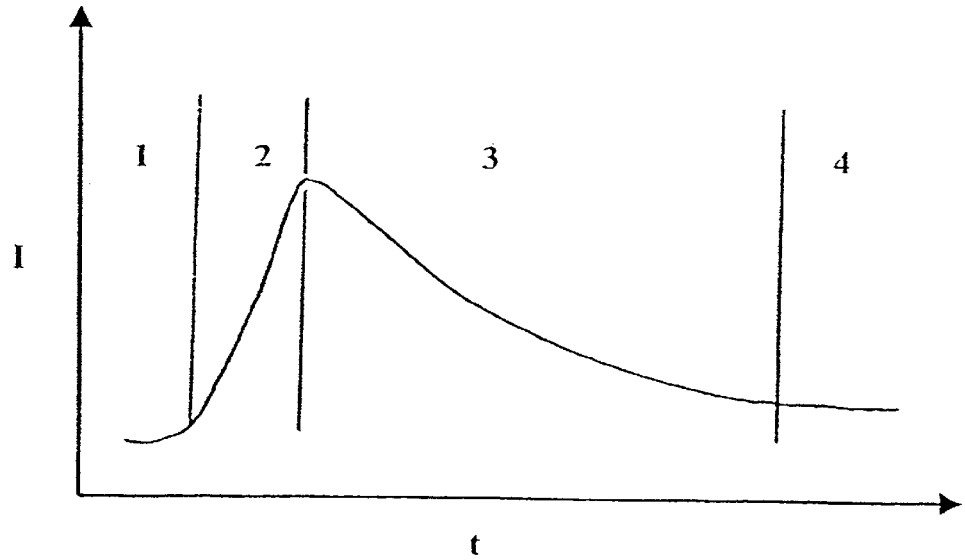
FIG. 2 presents development of fibre mobility as a function of residence time t.

When the fibre mobility is measured with methods described above, information is obtained on the mobility of individual fibres, which has been found to describe well the level of floc size and fibre network forming. Indirect data can be obtained from the fibre mobility about the intensity of the turbulent movement of fibres, about the parameters of the location correlation and the parameters concerning the shape of the velocity distribution. The graph depicted in FIG. 2 describes the intensity I of the movement of fibres of the fibre suspension, that is, development of the fibre mobility as a function of the residence time t. The intensity I of the fibre movement is inversely proportional to the floc volume. The graph is divided into four parts, in part 1 of which the fibre mobility of the fibre suspension is presented before fluidization, whereby the floc size is great and the mobility of fibres small. In part 2, the fibre suspension is fluidized, whereby the fibre mobility increases and the floc size reduces. Thereafter, re-flocculation follows in part 3, whereby the fibre mobility reduces as a function of time, until the flow state ends into a saturation state in part 4, in which the fibre mobility no longer significantly diminishes.

Figure 3:
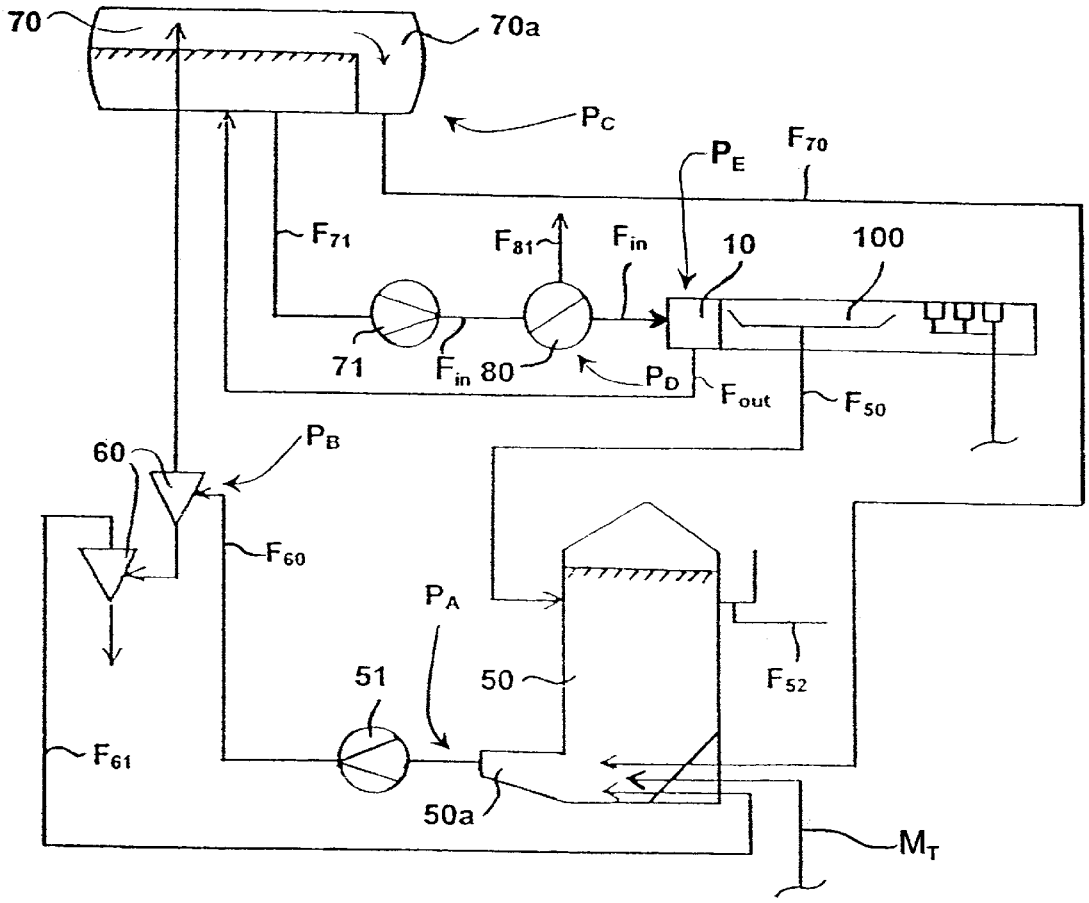
FIG. 3 presents a short circulation process arrangement.

FIG. 3 presents a short-circulation process arrangement, in which such process targets are presented in which the measurement and control arrangement of the mixing presented in FIG. 1 can be applied.

As shown in FIG. 3, the headbox 10 in short circulation feeds through its slice opening a stock suspension jet into the wire section 100. From the wire section 100, the water collecting apparatus conduct the water discharged through the wire as a flow $F_{50}$ into the wire pit 50. To the mixing area 50*a* of the mixing pit 50, a fresh stock flow $M_T$ is fed, the consistency whereof being in general on the order of 3%. While in the wire pit 50, the fresh stock is diluted into headbox consistency on the order of 1%. To the mixing area 50*a* of the wire pit 50, the suction side of a pump 51 is connected. From the pressure side of the pump 51, a stock flow $F_{60}$ diluted into the headbox consistency is directed through the hydrocyclones 60 to a deaeration tank 70.

In the deaeration tank 70, the air volume prevailing in underpressure is located above the free surface of the stock. The height of the stock surface is determined by the overflow 70*a* of the deaeration tank 70, across which a stock flow $F_{70}$, is flowing, from which the air is removed. Said stock flow $F_{70}$ is conducted to the mixing area 50*a* of the wire pit 50. In addition, a return flow $F_{61}$ is brought into said mixing area 50*a* from the accept of the second phase hydrocyclones. A fresh stock flow $M_T$ is also brought into said mixing area 50*a*. From the lower part of the deaeration tank 70, a stock flow $F_{71}$ is conducted to the suction side of the pump 71. The pump 71 feeds the inlet stock flow $F_{in}$ through the machine screen 80 to the stock inlet header of the headbox 10. The bypass $F_{out}$ of the stock inlet header of the headbox 10 is returned to the deaeration tank 70. Reject $F_{81}$ of the machine screen 80 is conducted to treatment of rejects.

According to the invention, targets appropriate for measuring and controlling the flow state in short circulation are the positions marked in the figure; in position $P_A$ in connection with the mixing area 50*a* of thick stock and wire water, in position $P_B$ in connection with the hydrocyclone unit 60, in position $P_C$ in connection with the deaeration unit 70, in position $P_D$ in connection with the machine screen 80.

FIG. 4A presents a mixing reactor MR, in which the control of the flow state according to the invention is implemented in the short circulation. Into the mixing reactor MR, two or more components $C_1$, $C_2$, . . . , are brought to be mixed, which are tried to get mixed into as homogeneous a stock mix $F_{mix}$ as possible. Said mixable components are for instance, thick stock and wire water.

FIG. 4B presents an actuator with which the control of the flow state of the invention can be implemented in mixing reactors MR located in different process phases of the short circulation, in which the components $C_1$ are mixed in the outer pipe $t_1$ and the $C_2$ in the inner pipe $t_2$. Component $C_1$ is, e.g., thick stock and component $C_2$, wire water. According to the invention, in the outlet end of the inner pipe $t_1$ of the mixing reactor, so-called delta wings $d_i$ are installed, the angle whereof being controllable with an exterior control. The outlet end of pipe $t_1$ comprises six delta wings $d_i$ in the present example, the angle of which is controlled by means of control actuators $d_C$. There may be also some other number of delta wings $d_i$ available. By opening the delta wings $d_i$, the outer flows can be restricted.

By closing the delta wings $d_i$, the inner pipe can be closed partly or entirely, so that no harmful dead volume is left in the inner pipe. The shape of the delta wing of the design of the invention is a highly efficient turbulence generator. FIG. 4C presents a delta wing structure of the invention, in which the delta wings $d_i$ limit more the flow of the inner pipe $t_2$.

In addition to what is described above, also other control means can be used for controlling the flow state in the short circulation. Such means are for instance controllable pipe expansions positioned before the cleaning units (hydrocyclones, deaeration tanks), in which the diameter of the pipes and or the location of a pipe expansion can be adjusted, and controls to be implemented in the machine screen, in which the wing angle, distance of the wing, pressure and/or speed of rotation can be controlled. In addition, controllable throttles can be positioned before the cleaning units.

Figure 5:
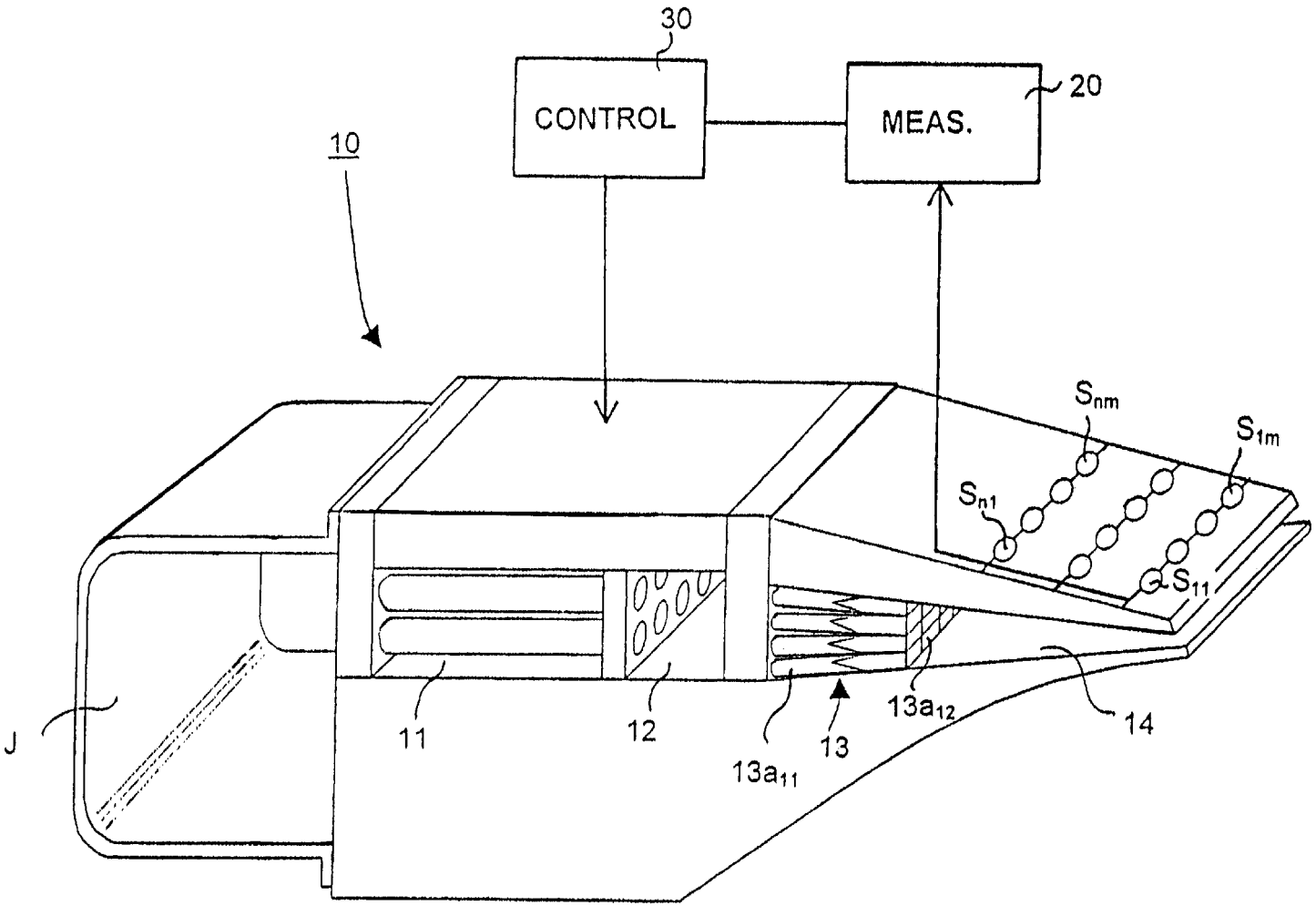
FIG. 5 presents an example of positioning a sensor matrix of the invention in the slice area of the headbox and the control system of the invention.

FIG. 5 presents the headbox 10 of a paper or board machine, comprising a stock inlet header J, tube bank 11, an intermediate chamber 12, a turbulence generator 13 and a slice channel 14. The headbox 10 is provided with a row of sensors or sensor matrix $S_{11}$, . . . , $S_{nm}$, in which the overall number of sensors is n x m. In the embodiment of FIG. 4, the sensors $S_{11}$, . . . , $S_{nm}$ are attached to the slice channel 14 so that the sensors S extend on the width and length of the slice channel 14. With the sensors S, the mobility of suspension fibres are measured and the sensors S are positioned preferably at equal distances e.g. 60 mm from each other. The sensors S can be positioned on the upper and lower surface of the slice channel in one-layer headboxes. In multi-layer headboxes the sensors S can be positioned on each layer. With one row of sensors, a momentary transverse profile illustrating the mobility of fibres can be measured. Using a sensor matrix, information can be moreover received about the fibre mobility in machine direction. The sensors $S_{11}$, . . . , $S_{nm}$ are attached to e.g. a slice cone, on the surfaces of the trailing elements or the tube bank and measuring signal leads are drawn therefrom to the receiving unit 20 processing the measurement data and transmitting it to the control unit 30 of the headbox. It is also possible to use a traversing sensor which keeps moving in cross-machine direction.

The mode of operation of the fibre mobility sensors can be based on a number of different quantities. The measurement can be performed e.g. on the basis of rapid pressure variations, whereby pressure sensors are used, or on the basis of acceleration, whereby surface friction sensors are used. Using various optical methods, e.g. laser Doppler anemometer, fibre mobility can be measured such as with sensors based on radioactive radiation, microwave measurement or ultrasonic measurement. On the basis of the fibre mobility data measured, such turbulence is generated in the flow state, with which the mobility of the fibre suspension is controlled to be optimal.

The headbox control unit 30 controls the transverse control of turbulence according to the invention in the headbox. For controlling the turbulence, a plurality of different methods and apparatus are known in the art. In U.S. Pat. No. 4,133,713, an arrangement is disclosed in which the turbulence is controlled by changing the length of the trailing element. Turbulence can also be generated by means of various geometric designs, such as step changes of flow channels and by means of flow channel surface structure (e.g. surface roughness, materials).

FIGS. 6A–6C and 7A–7B present a turbulence adjuster sleeve T to be disposed in the flow channel, wherewith the turbulence is adjusted with two nested sleeves $T_1$ and $T_2$ so that the inner sleeve $T_2$ is moved by rotating and/or pushing it relative to the outer sleeve $T_1$. The inner sleeve $T_2$ has a geometrical form wherewith an abrupt change is produced in the flow state and thus, turbulence at said point. Adjuster sleeves T can be positioned e.g. in the channels $\mathbf{13}_{a11}$, $\mathbf{13}_{a12}$, . . . of the turbulence generator.

Figure 6A:
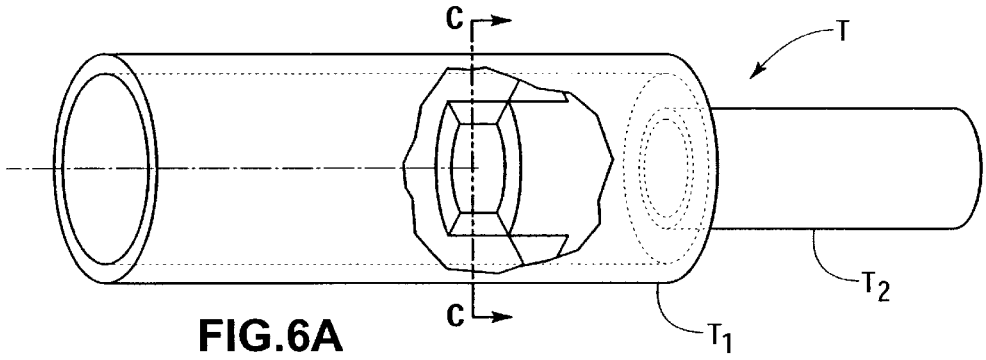
FIGS. 6A, 6B and 6C present one embodiment of a turbulence adjuster sleeve to be disposed in a flow channel.
Figure 6B:
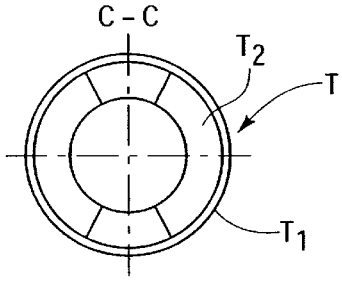
Figure 6C:
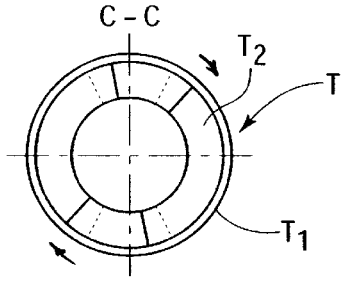

FIG. 6A presents in more detail a first way of adjusting the adjuster sleeve T of the invention, in which the flow state is changed by rotating the inner sleeve $T_2$. FIGS. 6B and 6C present section C—C of FIG. 6A, in which the inner sleeve $T_2$ is adjusted into two different positions for controlling the degree of turbulence.

Figure 7A:
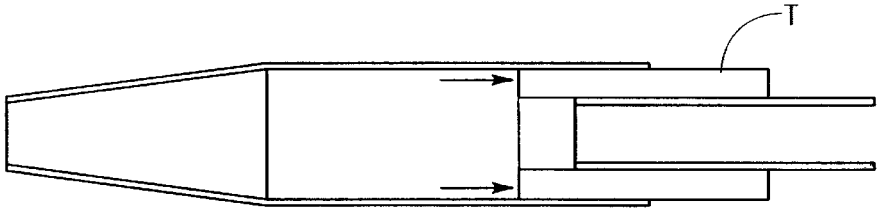
FIGS. 7A and 7B present a second embodiment of a turbulence adjuster sleeve to be disposed in a flow channel.
Figure 7B:
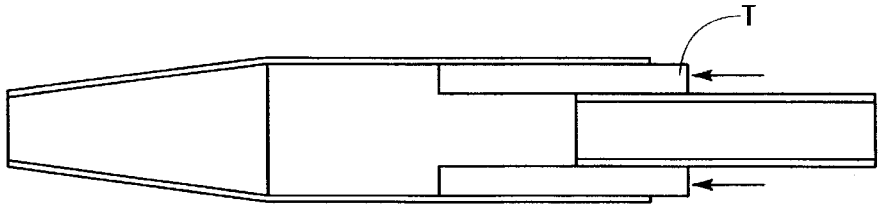

FIG. 7 presents a second adjustment form of the adjuster sleeve T. In this embodiment, the sleeve disposed within the flow pipe is moved in the machine direction, so that the adjustment is produced in the generation of the turbulence caused by the sleeve. In FIGS. 7A and 7B, by pushing the adjuster sleeve T disposed within the flow pipe V into different directions, a change can be produced in the flow state.

The rotation of the sleeve relative to its axis and/or moving it in the machine direction generates controlled changes in the strength and orientation of turbulence. By said mechanisms, e.g. control of turbulence intensity is obtained after the turbulence generator, that is at the beginning of the slice channel. Hence, it is also possible to profile the turbulence and consequently, also the fluidization of the suspension in cross-machine direction and/or in Z direction.

In the following, the patent claims will be given, and different details of the invention can show variation within the scope of the inventive idea defined in said claims and differ from what has been stated above by way of example only.

What is claimed is:

1. A method for measuring and controlling a short circulation in a headbox of a papermaking machine, said short circulation comprising apparatus for diluting stock into a headbox consistency and apparatus for cleaning the stock to be fed into the headbox, and wherein the headbox comprises a stock inlet header, a tube bank, at least one turbulence generator and a slice channel, the method comprising the steps of:

measuring fibre mobility of stock at a selected measurement target in the short circulation;

on the basis of the fibre mobility measured at the selected measurement target, adjusting a portion of the short circulation to control the stock mobility at least at the selected measurement target.

2. The method of claim 1, wherein the mobility at the selected measurement target is controlled to produce flow optimal for a further part of the short circulation in a headbox of a papermaking machine.

3. The method of claim 1 wherein the step of measuring the fibre mobility in the selected measurement target in the short circulation is performed using a sensor selected from the group consisting of: pressure sensors, acceleration sensors, optical phenomenon sensors, radioactive radiation sensors, ultrasonic sensors, and microwave sensors.

4. The method of claim 1 wherein the selected measurement target is selected to be a region no bigger than that in which fibres and other ingredients are mixed uniformly.

5. The method of claim 4 wherein the step of continuously measuring within the headbox a cross machine direction mobility profile is accomplished with an array of mobility sensors which extend in the cross machine direction and are mounted to the headbox.

6. The method of claim 4 wherein the step of continuously measuring within the headbox a cross machine direction mobility profile is accomplished by moving at least one mobility sensor in the cross machine direction on the headbox.

7. The method of claim 4 wherein a plurality of turbulence generators are positioned within the headbox and the plurality of turbulence generators is arranged to form a cross machine direction extending array.

8. The method of claim 1, wherein the portion of the short circulation adjusted to control the stock mobility is a mixing reactor which is provided with delta wings which are adjustable and wherein the stock mobility is controlled by adjusting the angle of the delta wings.

9. The method of claim 1 wherein the selected measurement target in the short circulation is selected from the group consisting of: a mixing area of wire water and a thick stock, a hydrocyclone unit, a deaeration unit, and a machine screen each of which is positioned in the short circulation.

10. The method of claim 1 further comprising measuring fibre mobility in a plurality of locations in a transverse direction in the headbox to determine a transverse fibre mobility profile for the headbox, and controlling the mobility of the headbox based on the transverse fibre mobility profile.

11. The method of claim 10 wherein the step of controlling the mobility of the headbox includes the step of adjusting a flow structure within the headbox.

12. The method of claim 1 further comprising the step of positioning a plurality of fibre mobility sensors fin the slice channel.

13. The method of claim 1 wherein a sensor selected from the group consisting of pressure sensors, acceleration sensors, optical phenomenon sensors, radioactive radiation sensors, ultrasonic sensors, and microwave sensors, is moved in the cross machine direction.

14. The method of claim 1 wherein in the mobility of the fibre suspension is controlled before the fibre mobility measurement.

15. A method of forming a paper web on a papermaking machine comprising the steps of:

flowing a quantity of papermaking stock through a headbox to form a cross machine direction extending stock suspension jet;

feeding the jet into a wire section of the papermaking machine;

continuously measuring within the headbox a cross machine direction mobility profile; and responsive to the cross machine direction mobility profile adjusting at least one turbulence generator positioned within the headbox.

16. A headbox of a paper machine, comprising:

stock inlet header;

a tube bank in stock receiving relation with the stock inlet header;

a turbulence generator in stock receiving relation with the tube bank;

a slice channel in stock receiving relation with the turbulence generator;

a plurality of means for measuring fibre mobility arrayed in the cross machine direction and mounted to the headbox, and means for changing mobility of stock within the headbox on the basis of measurement data obtained from the sensors.

17. The headbox of claim 16, wherein the sensors are disposed in the slice channel of the headbox.

18. The headbox of claim 16, wherein the sensors are arranged into a matrix disposed in the slice channel of the headbox.

19. The headbox of claim 16, wherein the means for changing mobility of stock includes means for controlling the transverse turbulence profile of the headbox.

20. The headbox of claim 16, wherein th means for controlling the transverse turbulence profile of the headbox includes individual turbulence generators which are provided with adjustable sleeves.

21. A short circulation of a paper machine, comprising:

a wire pit;

apparatus for diluting thick stock into headbox consistency stock;

apparatus for cleaning stock to be fed into the headbox;

a headbox;

piping connecting the wire pit to the apparatus for diluting thick stock into headbox consistency stock, and connecting the apparatus for diluting thick stock into headbox consistency stock to the apparatus for cleaning stock, and connecting the apparatus for cleaning stock to the bead box;

a sensor arranged within the short circulation of the paper machine to measure the fibre mobility of the fibre suspension in the short circulation;

a means for changing the mobility at a selected location within the short circulation, the means in data receiving relation to the sensor, the means forming a part of the short circulation of the papermaking machine data receiving relation to the plurality of fibre mobility sensors.

22. The short circulation of claim 21, wherein the sensor is positioned in the apparatus for diluting thick stock into headbox consistency stock.

23. The short circulation of claim 21, wherein the sensor is positioned in the apparatus for cleaning stock to be sent to the headbox.

24. The short circulation of claim 21, further comprising a hydrocyclone unit connected by the piping between the apparatus for diluting thick stock into headbox consistency stock and the apparatus for cleaning stock, wherein the sensor is positioned in the hydrocyclone unit.

25. The short circulation of claim 24, further comprising a deaeration unit connected by the piping between the apparatus hydrocyclone unit and the apparatus for cleaning stock, wherein the sensor is positioned in the deaeration unit.

26. The short circulation of claim 21, wherein the means for changing the mobility is positioned before the sensor.

27. A headbox in a papermaking machine comprising:

a stock inlet header;

a tube bank in stock receiving relation with the stock inlet header;

a slice forming a slice channel in stock receiving relation to the tube bank;

a plurality of fiber mobility sensors mounted on the slice, to form a cross machine direction array which provides a cross machine direction mobility profile;

a plurality of structures for producing adjustable turbulence positioned in the headbox, in data receiving relation to the plurality of fiber mobility sensors, the plurality of structures for producing turbulence being adjustable so as to control the cross machine direction mobility profile.

* * * * *

UNITED STATES PATENT AND TRADEMARK OFFICE

CERTIFICATE OF CORRECTION

PATENT NO. : 6,551,459 B1
DATED : April 22, 2003
INVENTOR(S) : Lumiala et al.

It is certified that error appears in the above-identified patent and that said Letters Patent is hereby corrected as shown below:

Title page,
Item [57], ABSTRACT,
Line 2, "tubulence" should be -- turbulence --.

Column 4,
Line 36, "e.g.," should be -- e.g. --.

Column 8,
Line 30, "fin" should be -- in --.
Lines 50-51, "profile" should be -- profile --.

Column 9,
Line 25, "bead box" should be -- headbox --.

Signed and Sealed this

Nineteenth Day of October, 2004

JON W. DUDAS
*Director of the United States Patent and Trademark Office*

UNITED STATES PATENT AND TRADEMARK OFFICE

CERTIFICATE OF CORRECTION

PATENT NO. : 6,551,459 B1
DATED : April 22, 2003
INVENTOR(S) : Pauli Koutonen

It is certified that error appears in the above-identified patent and that said Letters Patent is hereby corrected as shown below:

Column 8,
Lines 50-51, "profile" should be -- profile; and responsive to the cross machine direction mobility profile --

Signed and Sealed this

Fourth Day of January, 2005

JON W. DUDAS
*Director of the United States Patent and Trademark Office*